US009164458B2

(12) United States Patent
Muroi

(10) Patent No.: US 9,164,458 B2
(45) Date of Patent: Oct. 20, 2015

(54) IMAGE FORMING APPARATUS

(71) Applicant: Hideo Muroi, Kanagawa (JP)

(72) Inventor: Hideo Muroi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/499,040

(22) Filed: Sep. 26, 2014

(65) Prior Publication Data

US 2015/0093132 A1 Apr. 2, 2015

(30) Foreign Application Priority Data

Sep. 27, 2013 (JP) ..... 2013-202353

(51) Int. Cl.
*G03G 15/00* (2006.01)

(52) U.S. Cl.
CPC ..... *G03G 15/55* (2013.01); *G03G 15/5041* (2013.01); *G03G 15/5054* (2013.01)

(58) Field of Classification Search
USPC ..... 399/49, 72
See application file for complete search history.

(56) References Cited

U.S. PATENT DOCUMENTS 8,090,281 B2 * 1/2012 Hirota et al. ..... 399/49
2012/0315056 A1 12/2012 Muroi et al.

FOREIGN PATENT DOCUMENTS

| | | |
|---|---|---|
| JP | 2006-284892 | 10/2006 |
| JP | 2011-109394 | 6/2011 |
| JP | 2011-164240 | 8/2011 |

* cited by examiner

*Primary Examiner* — Minh Phan
(74) *Attorney, Agent, or Firm* — Duft Bornsen & Fettig LLP

(57) ABSTRACT

An image forming apparatus includes an image carrier, an image forming unit, a density sensor, a gradation characteristic data generator, and a gradation corrector. The density sensor includes a low-pass filter to remove a high-frequency component of an output of the image density sensor. The gradation characteristic data generator forms a gradation correction pattern on the image carrier. The gradation correction pattern is a continuous gradation pattern including first and second patterns. The gradation characteristic data generator continuously detects image density of the continuous gradation pattern and background areas adjacent to the continuous gradation pattern to generate the gradation characteristic data. The gradation characteristic data generator forms a compensation pattern on the image carrier next to and continuous with a leading end of the first pattern in an image carrier rotational direction, to compensate for a response delay of the output of the density sensor due to the low-pass filter.

8 Claims, 11 Drawing Sheets

IMAGE FORMING APPARATUS

CROSS-REFERENCE TO RELATED APPLICATIONS

This patent application is based on and claims priority pursuant to 35 U.S.C. §119(a) to Japanese Patent Application No. 2013-202353, filed on Sep. 27, 2013, in the Japan Patent Office, the entire disclosure of which is hereby incorporated by reference herein.

BACKGROUND

1. Technical Field

Embodiments of the present invention generally relate to an image forming apparatus such as a printer, a facsimile machine, or a copier.

2. Background Art

Various types of electrophotographic image forming apparatuses are known, including copiers, printers, facsimile machines, or multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor serving as an image carrier. An optical writer irradiates the surface of the photoconductor thus charged with a light beam to form an electrostatic latent image on the surface of the photoconductor according to the image data. A development device supplies toner to the electrostatic latent image thus formed to render the electrostatic latent image visible as a toner image. The toner image is then transferred onto a recording medium directly, or indirectly via an intermediate transfer belt. Finally, a fixing device applies heat and pressure to the recording medium carrying the toner image to fix the toner image onto the recording medium. Thus, the image is formed on the recording medium.

To stabilize image density of a multi-gradation image formed on a recording medium, such image forming apparatuses typically generate gradation characteristic data using a gradation correction pattern having known gradation levels to correct gradation of image data of a gradation image to be outputted.

For example, a gradation correction pattern having patches for each of a plurality of input gradation levels may be formed on the intermediate transfer belt serving as an image carrier. A density sensor detects image density of each patch. According to the detected density of the gradation correction pattern, gradation characteristic data is generated that shows a relation between the image density and the gradation levels in a gradation range of the multi-gradation image. The gradation is then corrected upon formation of the multi-gradation image using the gradation characteristic data.

SUMMARY

In one embodiment of the present invention, an improved image forming apparatus is described that includes an image carrier, an image forming unit, a density sensor, a gradation characteristic data generator, and a gradation corrector. The image carrier is rotatable at a predetermined speed to carry an image on a surface thereof. The image forming unit forms a multi-gradation image on the image carrier. The density sensor detects density of the multi-gradation image formed on the image carrier. The density sensor includes a low-pass filter to remove a high-frequency component of an output of the image density sensor. The gradation characteristic data generator forms a gradation correction pattern on the image carrier with the image forming unit, detects image density of the gradation correction pattern using the density sensor, and generates gradation characteristic data that shows a relation between the image density and a plurality of gradation levels in a gradation range used for forming the multi-gradation image according to a detected image density of the gradation correction pattern. The gradation corrector corrects image data of the multi-gradation image to be outputted, according to the gradation characteristic data.

The gradation correction pattern is a continuous gradation pattern including a first pattern and a second pattern. The first pattern has gradation levels changing continuously from a maximum gradation level to a minimum gradation level in the gradation range. The second pattern is continuous with the first pattern in a direction in which the image carrier rotates, and has gradation levels changing continuously from the minimum gradation level to the maximum gradation level in the gradation range. The gradation characteristic data generator continuously detects, with the density sensor, image density of the continuous gradation pattern formed on the image carrier and image density of background areas adjacent to a leading end and a trailing end of the continuous gradation pattern, respectively, in the direction in which the image carrier rotates, in a predetermined sampling period, to generate the gradation characteristic data according to detected image density of the continuous gradation pattern and image density of the background areas.

The gradation characteristic data generator forms a compensation pattern on the surface of the image carrier next to a leading end of the first pattern in the direction in which the image carrier rotates. The compensation pattern is continuous with the first pattern, and has a length in the direction in which the image carrier rotates sufficient to compensate for a response delay of the output of the density sensor due to the low-pass filter.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
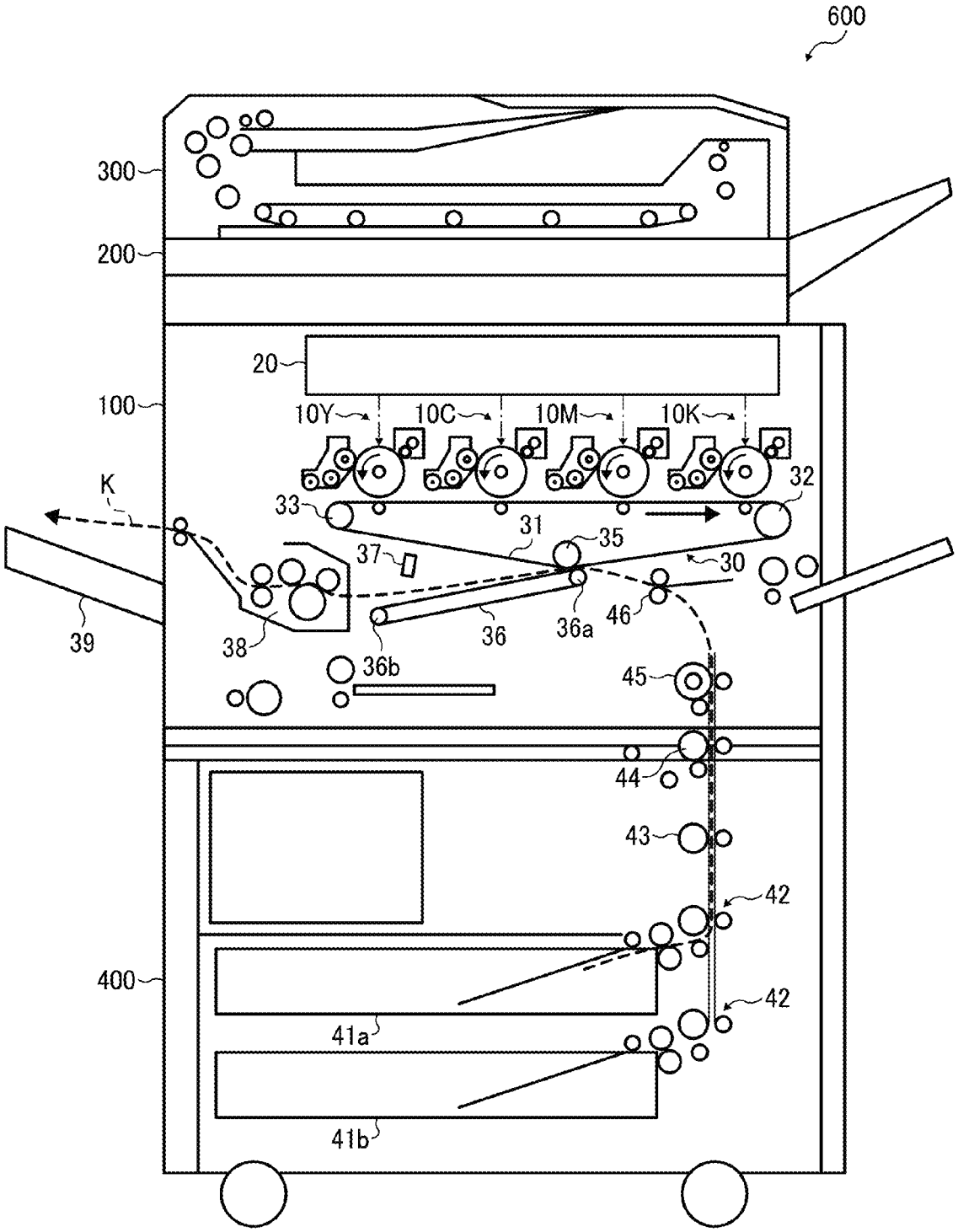
FIG. 1 is a schematic view of an image forming apparatus according to an embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and all of the components or elements described in the embodiments of the present invention are not necessarily indispensable to the present invention.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

It is to be noted that, in the following description, suffixes Y, M, C, and K denote colors yellow, magenta, cyan, and black, respectively. To simplify the description, these suffixes are omitted unless necessary.

Referring now to the drawings, wherein like reference numerals designate identical or corresponding parts throughout the several views, embodiments of the present invention are described below.

Figure 2:
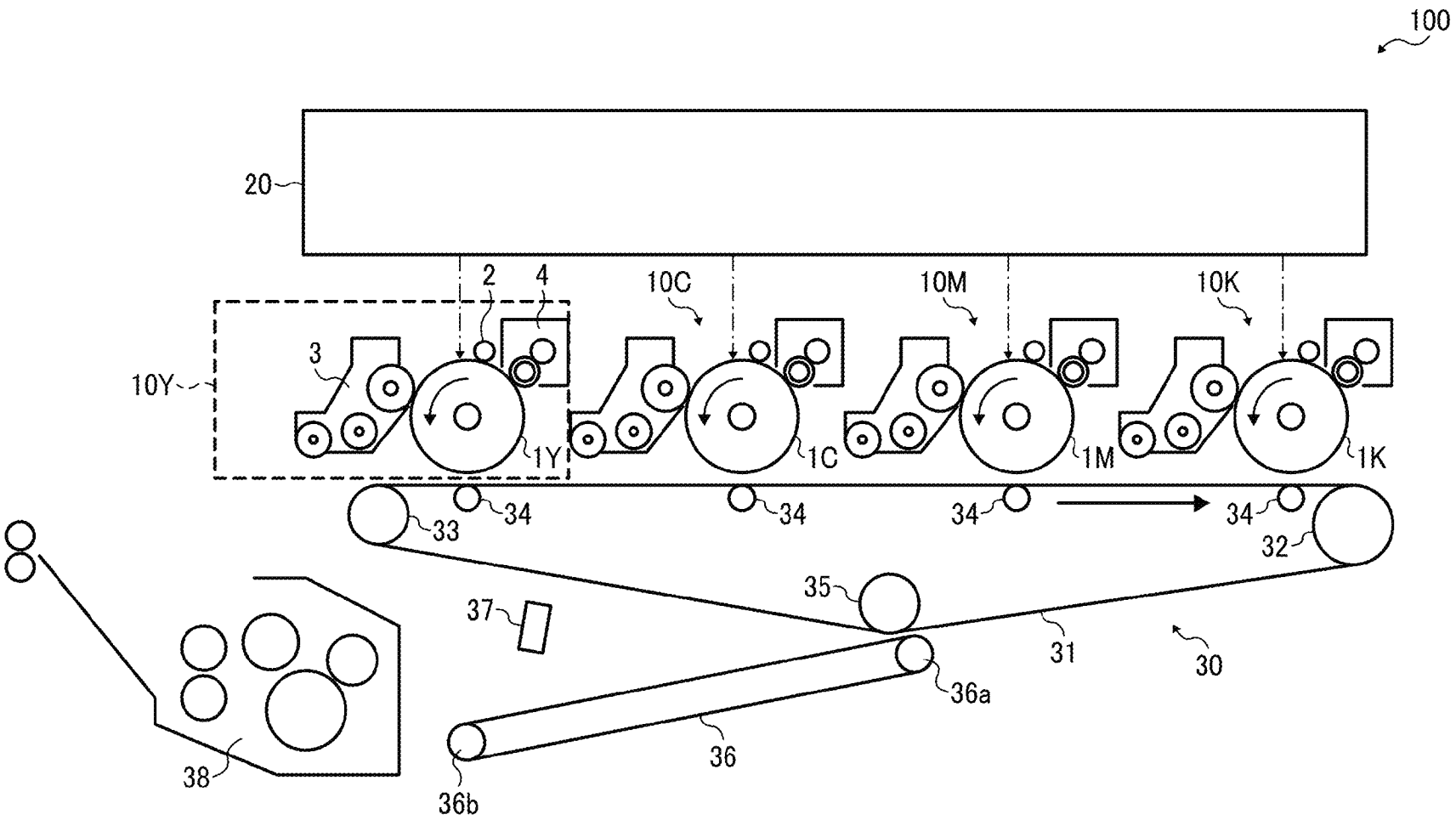
FIG. 2 is a partially enlarged view of an image forming unit incorporated in the image forming apparatus of FIG. 1.

Initially with reference to FIGS. 1 and 2, a description is given of an image forming apparatus 600 according to an embodiment of the present invention.

FIG. 1 is a schematic view of the image forming apparatus 600. FIG. 2 is a partially enlarged view of an image forming unit 100 incorporated in the image forming apparatus 600.

The image forming apparatus 600 includes, e.g., the image forming unit 100 to form an image on a recording medium, a feed unit 400 to supply the recording medium to the image forming unit 100, a scanner 200 serving as an image reader to read an image of a document, and an automatic document feeder (ADF) 300 to automatically supply the document to the scanner 200.

It is to be noted that the image forming apparatus 600 of the present embodiment is capable of forming a full-color image with toner of yellow (Y), cyan (C), magenta (M), and black (K).

A transfer unit 30 is disposed in the image forming unit 100. As illustrated specifically in FIG. 2, the transfer unit 30 includes an endless intermediate transfer belt 31 serving as a transfer body, and a plurality of rollers, such as a drive roller 32, a driven roller 33, and a secondary-transfer backup roller 35, around which the intermediate transfer belt 31 is stretched.

The intermediate transfer belt 31 is made of resin material having low stretchability, such as polyimide, in which carbon powder is dispersed to adjust electrical resistance. The endless intermediate transfer belt 31 is moved by rotation of the drive roller 32 while being stretched around the secondary-transfer backup roller 35, the driven roller 33, four primary-transfer rollers 34 and the drive roller 32.

An optical writing unit 20 is disposed above four process units 10Y, 10C, 10M, and 10K that include photoconductive drums 1Y, 1C, 1M, and 1K serving as first image carriers, respectively. The optical writing unit 20 includes four laser diodes (LDs) driven by a laser controller to emit four laser beams as writing light according to image data.

The optical writing unit 20 irradiates the photoconductive drums 1Y, 1C, 1M, and 1K with the four writing light beams, respectively, to form electrostatic images on surfaces of the photoconductive drums 1Y, 1C, 1M, and 1K, respectively.

According to the present embodiment, the optical writing unit 20 further includes, e.g., light deflectors, reflecting mirrors, and optical lenses. In the optical writing unit 20, the laser beams emitted by the laser diodes (LDs) are deflected by the light deflectors, reflected by the reflecting mirrors and pass through the optical lenses to finally reach the surfaces of the photoconductive drums 1. Thus, the surfaces of the photoconductive drums 1 are irradiated with the laser beams. Alternatively, the optical writing unit 20 may include a light emitting diode (LED) to irradiate the surfaces of the photoconductive drums 1 with the laser beams.

The four process units 10 are identical in configuration, differing only in their developing colors. Specifically, each of the four process units 10 includes the photoconductive drum 1 as described above, and further includes, e.g., a charging unit 2, a development unit 3, and a cleaning unit 4 surrounding the photoconductive drum 1. The charging unit 2 charges the surface of the photoconductive drum 1 before the optical writing unit 20 irradiates the surface of the photoconductive drum 1 with the writing light to form an electrostatic latent image thereon. The development unit 3 develops the electrostatic latent image formed on the surface of the photoconductive drums 1 with toner. The cleaning unit 4 cleans the surface of the photoconductive drum 1 after a primary-transfer process.

The electrostatic latent images formed on the surface of the photoconductive drums 1 in an exposure process performed by the optical writing unit 20 are developed in a development process, in which toner of yellow, cyan, magenta, and black colors accommodated in the respective developing units 3 electrostatically adhere to the surfaces of the photoconductive drums 1. Then, the toner images formed on the surfaces of the photoconductive drum 1 are sequentially transferred onto the intermediate transfer belt 31 serving as a second image carrier while being superimposed one atop another to form a desired full-color toner image on the intermediate transfer belt 31.

Referring back to FIG. 1, the feed unit 400 includes, e.g., a plurality of vertically disposed trays 41*a* and 41*b*, and feed devices 42. One of the feed devices 42 feeds a recording medium from the corresponding tray 41*a* or 41*b* to a pair of registration rollers 46 via conveyor rollers 43 through 45 along a conveyance passage K.

At a predetermined time, the pair of registration rollers 46 conveys the recording medium to a secondary-transfer nip formed between the secondary-transfer backup roller 35 and a roller 36*a* facing the secondary-transfer backup roller 35. As illustrated specifically in FIG. 2, a conveyor belt 36 is stretched around the roller 36*a* and a roller 36*b*.

While the recording medium passes through the secondary-transfer nip along with the conveyor belt 36, the full-color toner image formed on the intermediate transfer belt 31 is transferred onto the recording medium. Specifically, the four color toner images superimposed one atop another on the intermediate transfer belt 31 are transferred onto the recording medium at once. Then, the recording medium carrying the full-color toner image thereon passes through a fixing unit 38, in which the full-color toner image is fixed onto the recording medium as a color print image. Finally, the recording medium is discharged onto a discharge tray 39 provided outside a body of the image forming apparatus 600.

Figure 3:
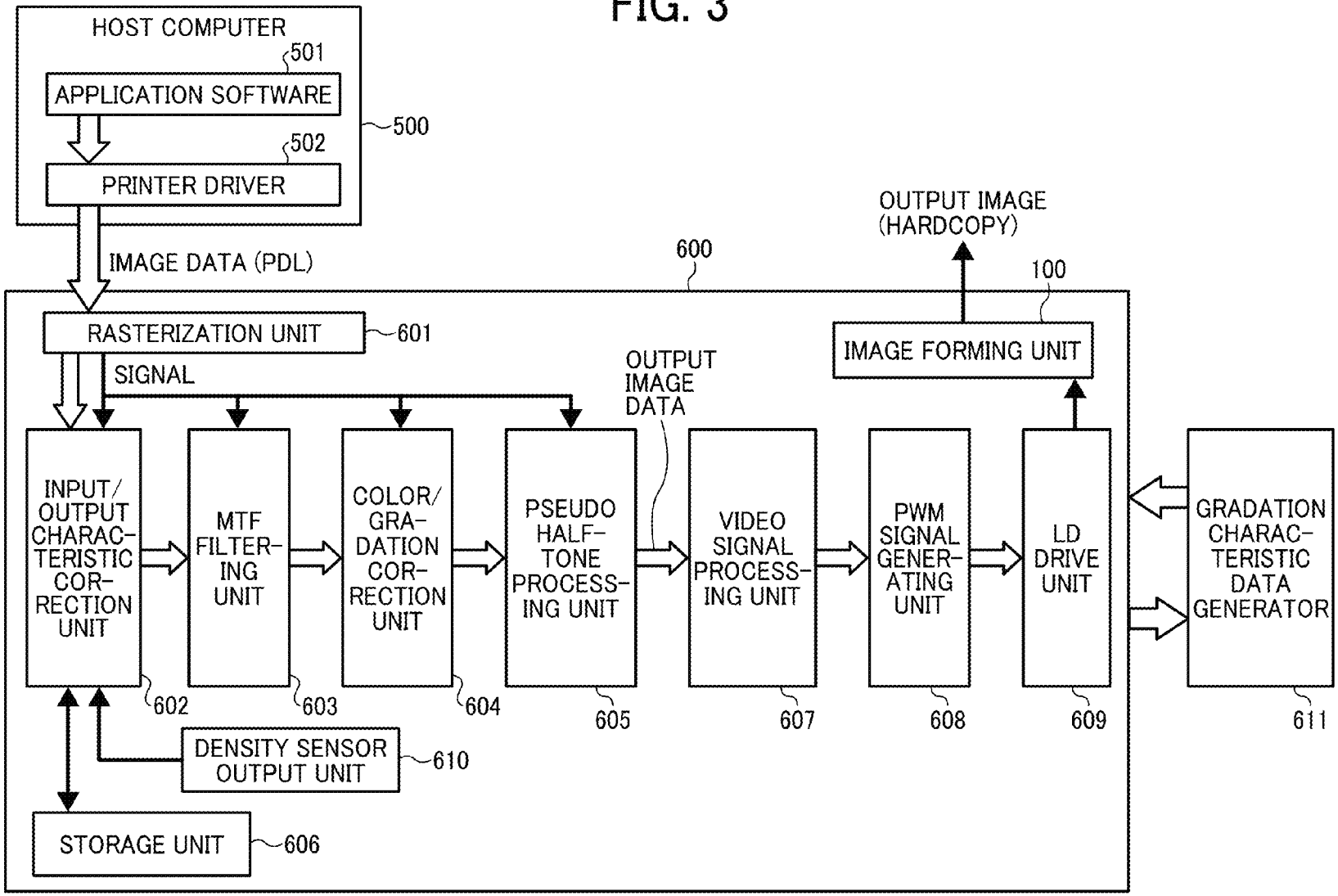
FIG. 3 is a block diagram illustrating a flow of image data processing.

As illustrated in FIG. 3, the image forming apparatus 600 also includes a controller 611. The controller 611 is implemented as a central processing unit (CPU) such as a microprocessor to perform various types of control described later, and provided with control circuits, an input/output device, a clock, a timer, and a storage unit 606 including both nonvolatile memory and volatile memory.

The storage unit 606 stores various types of control programs and information such as outputs from sensors and results of correction control. The controller 611 also serves as a gradation characteristic data generator to generate gradation characteristic data that shows a relation between image density and a plurality of gradation levels in a gradation range used for forming a multi-gradation image. In such a case, the controller 611 forms a gradation correction pattern on an image carrier such as the intermediate transfer belt 31 with the image forming unit 100. The controller 611 also detects image density of the gradation correction pattern with a density sensor array 37. According to a detected image density of the gradation correction pattern, the controller 611 generates the gradation characteristic data. A detailed description is given later of generation of the gradation characteristic data.

According to the present embodiment, the image forming apparatus 600 performs image data processing by, e.g., forming an area coverage modulation pattern on an image carrier such as the photoconductive drum 1 or the intermediate transfer belt 31 and detecting the area coverage modulation pattern to correct gradation characteristics.

Specifically, the image forming apparatus 600 includes the image forming unit 100 serving as a gradation pattern forming unit to form a gradation pattern on the image carrier such as the photoconductive drum 1 or the intermediate transfer belt 31, and a density sensor array 37 serving as a density sensor to detect density of the gradation pattern. The image forming apparatus 600 further includes an input/output characteristic correction unit 602 serving as a device for forming an input/output characteristic correction signal. The controller 611 correct gradation by an input/output characteristic adjusting process.

Referring now to FIG. 3, a description is given of image data processing of an image to be outputted, that is, an image to be formed, in the image forming apparatus 600 described above. Specifically, a description is given of the image data processing starting from image processing and signal processing of input image data to generate a laser drive signal to be transmitted to the optical writing unit 20.

FIG. 3 is a block diagram illustrating a specific example of flow of image data processing performed by the above-described components of the image forming apparatus 600.

Firstly, image data is inputted to the image forming apparatus 600 illustrated in FIG. 1 from application software 501 on an external host computer 500 via a printer driver 502. At this time, the image data is converted to page description language (PDL) by the printer driver 502. When receiving the image data described in the PDL as input data, the rasterization unit 601 interprets the input data and forms a rasterized image from the input data.

At this time, signals showing types and attributions of e.g., characters, lines, photographs, and graphic images are generated for each object. The signals are transmitted to, e.g., an input/output characteristic correction unit 602, a modulation transfer function filtering unit 603 (hereinafter simply referred to as MTF filtering unit 603), a color correction and gradation correction unit 604 (hereinafter simply referred to as color/gradation correction unit 604), and a pseudo halftone processing unit 605.

In the input/output characteristic correction unit 602 serving as a device for forming an input/output characteristic correction signal, gradation levels in the rasterized image are corrected to obtain desired characteristics according to an input/output characteristic correction signal.

The input/output characteristic correction unit 602 uses an output of the density sensor array 37 received from a density sensor output unit 610 while giving and receiving information to and from the storage unit 606 including both nonvolatile memory and volatile memory, thereby forming the input/output characteristic correction signal and performing correction.

The input/output characteristic correction signal thus formed is stored in the nonvolatile memory of the storage unit 606 to be used for subsequent image formation.

The MTF filtering unit 603 selects the optimum filter for each attribution according to the signal transmitted from the rasterization unit 601, thereby performing an enhancement process.

It is to be noted that a typical MTF filtering process is herein employed, therefore a detailed description of the MTF filtering process is omitted. The image data is transmitted to the color/gradation correction unit 604 after the MTF filtering process is performed in the MTF filtering unit 603.

The color/gradation correction unit 604 performs various correction processes, such as a color correction process and a gradation correction process described below. In the correction process, a red-green-blue (RGB) color space, that is, a PDL color space inputted from the host computer 500, is converted to a color space of the colors of toner used in the image forming unit 100, and more specifically, to a cyan-magenta-yellow-black (CMYK) color space. The color correction process is performed according to the signal transmitted from the rasterization unit 601 by using an optimum color correction coefficient for each attribution.

The gradation correction process is performed to correct the image data of the multi-gradation image to be outputted, according to gradation characteristic data generated by using a gradation correction pattern described later. Thus, the color/gradation correction unit 604 serves as a gradation corrector to correct image data of a multi-gradation image to be outputted according to the gradation characteristic data. It is to be noted that a typical color/gradation correction process can be herein employed, therefore a detailed description of the color/gradation correction process is omitted.

The image data is then transmitted from the color/gradation correction unit 604 to the pseudo halftone processing unit 605. The pseudo halftone processing unit 605 performs a pseudo halftone process to generate an output image data. For example, the pseudo halftone process is performed on the data after the color/gradation correction process by dithering. In short, quantization is performed by comparison with a pre-stored dithering matrix.

The output image data is then transmitted from the pseudo halftone processing unit 605 to a video signal processing unit 607. The video signal processing unit 607 converts the output image data to a video signal. Then, the video signal is transmitted to a pulse width modulation signal generating unit 608 (hereinafter referred to as PWM signal generating unit 608). The PWM signal generating unit 608 generates a PWM signal as a light source control signal according to the video signal. Then, the PWM signal is transmitted to a laser diode drive unit 609 (hereinafter simply referred to as LD drive unit 609). The LD drive unit 609 generates a laser diode (LD) drive signal according to the PWM signal. The laser diodes (LDs) as light sources incorporated in the optical writing unit 20 are driven according to the LD drive signal.

Figure 4A:
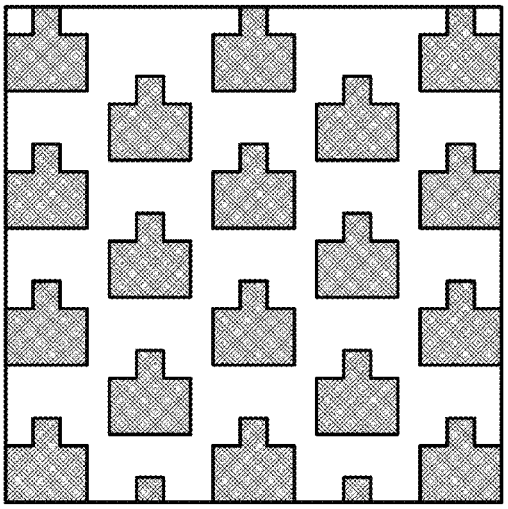
FIG. 4A is a schematic view of a dot-like area coverage modulation pattern that constitutes a gradation pattern.
Figure 4B:
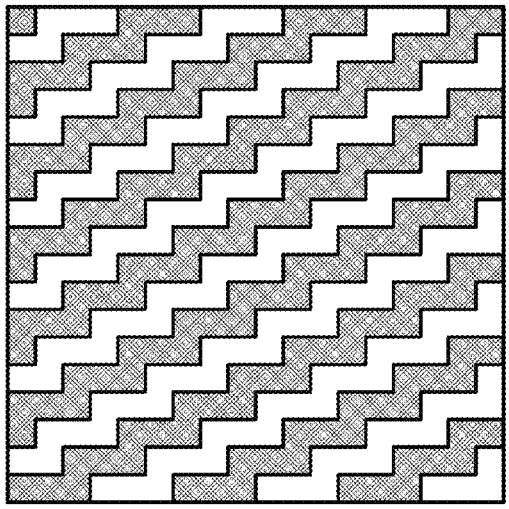
FIG. 4B is a schematic view of a linear area coverage modulation pattern that constitutes a gradation pattern.

Referring now to FIGS. 4A and 4B, a description is given of area coverage modulation patterns individually constituting a gradation pattern P' described later.

FIG. 4A is a schematic view of a dot-like area coverage modulation pattern. FIG. 4B is a schematic view of a linear area coverage modulation pattern.

According to the signal transmitted from the rasterization unit 601, a dithering matrix having the optimum number of lines and screen angle is selected for the optimum pseudo halftone process.

Figure 5:
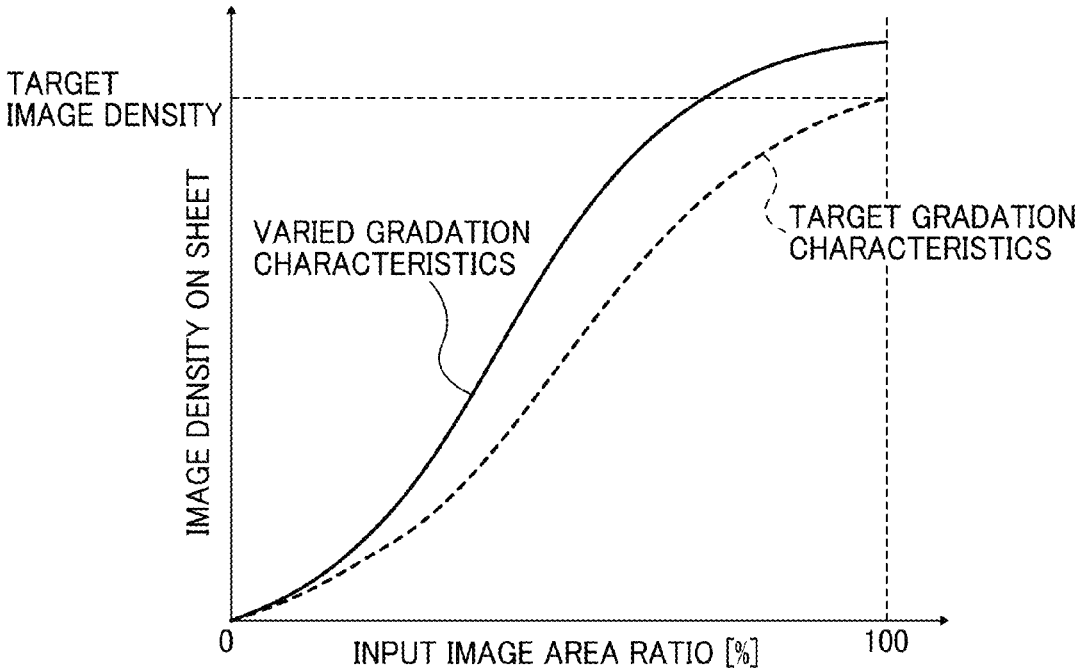
FIG. 5 is a graph of a relation between input image area ratio and image density on paper when gradation characteristics vary.

FIG. 5 is a graph of a relation between input image area ratio and image density on paper when gradation characteristics vary.

As illustrated in FIG. 5, desired gradation characteristics may not be obtained with respect to an input image area ratio when circumstances change, the image forming unit 100 deteriorates, and/or toner density changes in the development unit 3.

Generally, when the toner density increases in the development unit 3, an increased amount of toner attaches to a latent image because the charge on the toner decreases. As a result, an overall image density on paper increases. By contrast, when the toner density decreases in the development unit 3, a decreased amount of toner attaches to the latent image because the charge on the toner increases. As a result, the overall image density on paper decreases. Such variations in gradation characteristics significantly affect colors created by superimposing two or three colors one atop another, and therefore to be corrected to target gradation characteristics.

Figure 6A:
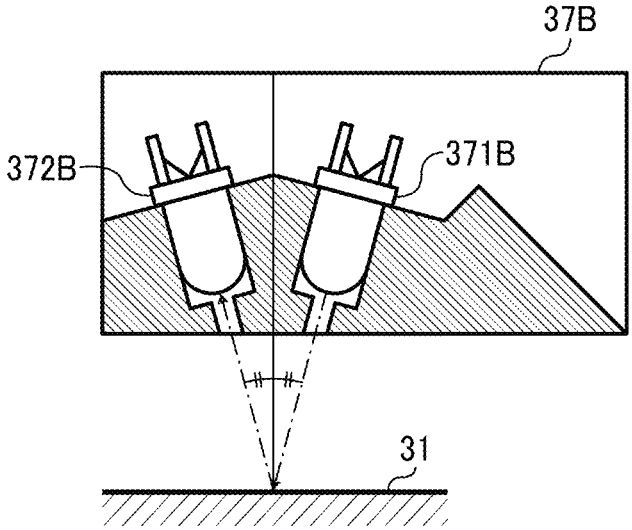
FIG. 6A is a schematic view of a density sensor for a black toner image incorporated in the image forming apparatus of FIG. 1.
Figure 6B:
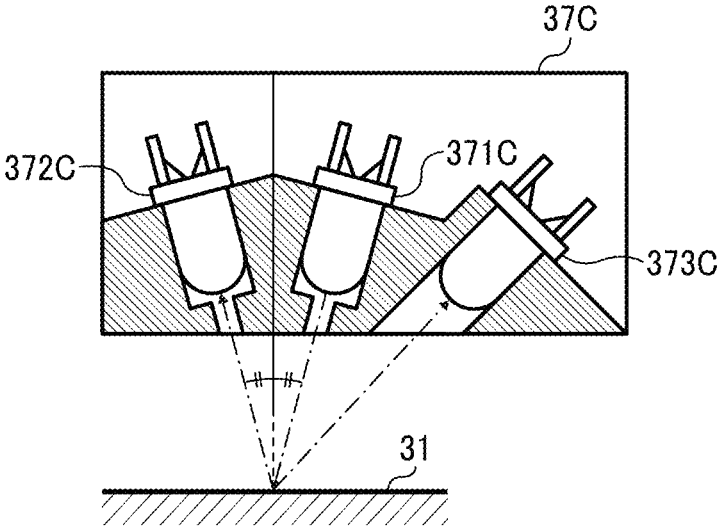
FIG. 6B is a schematic view of a density sensor for a toner image of another color incorporated in the image forming apparatus of FIG. 1.

As described above, the density sensor array 37 illustrated in FIGS. 1 and 2 detects the density of a gradation pattern formed on the intermediate transfer belt 31. Referring now to FIGS. 6A and 6B, a detailed description is given of the density sensor array 37. The density sensor array 37 includes density sensors 37B and 37C.

FIG. 6A is a schematic view of the density sensor 37B for a black toner image. FIG. 6B is a schematic view of the density sensor 37C for a toner image of another color.

As illustrated in FIG. 6A, the density sensor 37B includes a light emitting element 371B such as a light emitting diode (LED), and a light receiving element 372B to receive regular reflection light.

The light emitting element 371B emits light onto the intermediate transfer belt 31. The light is reflected from an outer surface of the intermediate transfer belt 31. The light receiving element 372B receives the regular reflection light out of the light reflected from the outer surface of the intermediate transfer belt 31.

On the other hand, as illustrated in FIG. 6B, the density sensor 37C includes a light emitting element 371C such as a light emitting diode (LED), a light receiving element 372C to receive regular reflection light, and a light receiving element 373C to receive diffused reflection light.

Similar to the density sensor 37B, the light emitting element 371C emits light onto the intermediate transfer belt 31. The light is reflected from the outer surface of the intermediate transfer belt 31. The light receiving element 372C receives the regular reflection light out of the light reflected from the outer surface of the intermediate transfer belt 31. The light receiving element 373C receives the diffused reflection light out of the light reflected from the outer surface of the intermediate transfer belt 31.

In the present embodiment, each of the light emitting elements 371B and 371C is, e.g., an infrared light emitting diode (LED) made of gallium arsenide (GaAs) that emits light having a peak wavelength of about 950 nm. Each of the light receiving elements 372B, 372C, and 373C is, e.g., a silicon phototransistor having a peak light-receiving sensitivity of about 800 nm.

Alternatively, however, the light emitting elements 371B and 371C may emit light having a peak wavelength different from that described above. Similarly, the light receiving elements 372B, 372C, and 373C may have a peak light-receiving sensitivity different from that described above.

In the present embodiment, the density sensor array 37 is disposed at a detection distance of about 5 mm from an object to detect, that is, the outer surface of the intermediate transfer belt 31. Output from the density sensor array 37 is transformed to image density or amount of toner attached using a predetermined transformation algorithm.

In the present embodiment, the density sensor array 37 is disposed facing the outer surface of the intermediate transfer belt 31. Alternatively, the density sensor 37B may be disposed facing the photoconductive drum 1K. Similarly, the density sensor 37C may be disposed facing each of the photoconductive drums 1Y, 1C, and 1M. Alternatively, the density sensor array 37 may be disposed facing the conveyor belt 36.

Further in the present embodiment, a first-order Butterworth low-pass filter having a time constant of about 20 ms is circuit implemented in the density sensor array 37 to accurately detect image density (amount of toner attached) by removing, e.g., the effects of instability of intermediate transfer belt 31 and variations in amount of toner attached within a gradation pattern at a sampling frequency or higher, in addition to electrical high-frequency noise.

Figure 7:
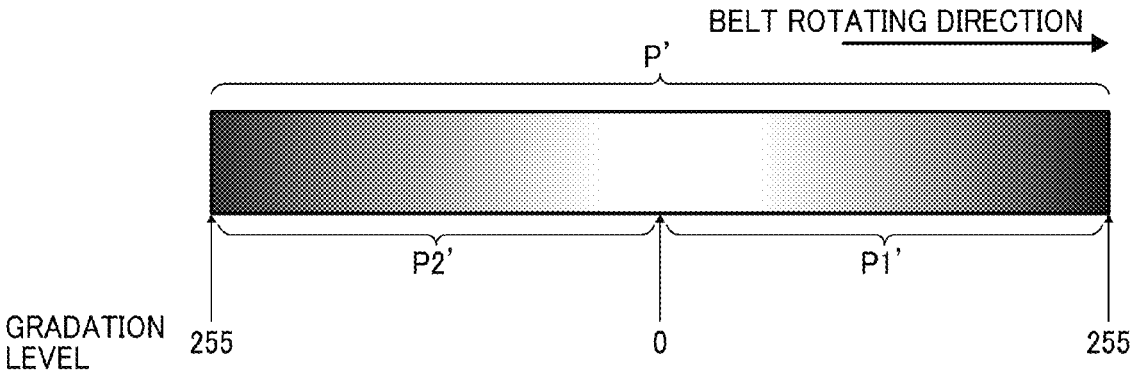
FIG. 7 is a plan view of a gradation pattern according to a comparative example.

FIG. 7 is a plan view of the gradation pattern P' according to a comparative example.

As illustrated in FIG. 7, the gradation pattern P' of the comparative example includes two gradation groups each having 256 gradation levels, namely, a first pattern P1' (first half) of gradation levels 255 to 0 and a second pattern P2' (second half) of gradation levels 0 to 255, continuously disposed in a direction in which the intermediate transfer belt 31 serving as an image carrier rotates (hereinafter referred to as belt rotating direction).

Specifically, the first pattern P1' includes gradations levels changing continuously from a maximum gradation level 255 to a minimum gradation level 0. The second pattern P2' includes gradation levels changing continuously from the minimum gradation level 0 to the maximum gradation level 255.

The first pattern P1' and the second pattern P2' of the gradation pattern P' are identical in length in the belt rotating direction.

Figure 8:
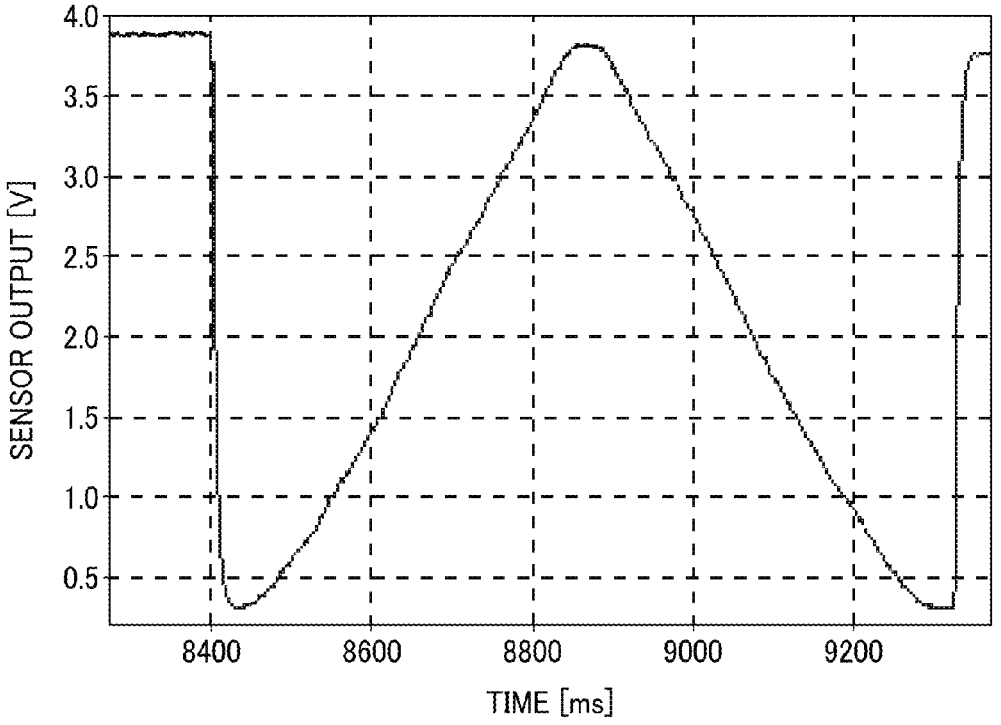
FIG. 8 is a graph of detected image density of the gradation pattern of FIG. 7, illustrating transition of the detected image density over time.

FIG. 8 is a graph of image density of the gradation pattern P' detected by the density sensor array 37, illustrating transition of the detected image density over time. In FIG. 8, the vertical axis indicates outputs (V) of the density sensor array 37 that detects the image density of the gradation pattern P'. The horizontal axis indicates an elapse of time after the density sensor array 37 starts to detect the image density.

FIG. 8 illustrates regular reflection output data obtained by the density sensor array 37, which includes the first-order Butterworth low-pass filter. Since the density sensor array 37 detects a specular reflection component from the surface of the intermediate transfer belt 31, the regular reflection output decreases as the amount of toner attached to the surface of the intermediate transfer belt 31 increases.

In FIG. 8, the bottom parts where an output wave dramatically drops down around 8400 ms and 9300 ms correspond to gradation level 255, while the top part of the output wave around 8850 ms corresponds to gradation level 0.

Comparing a leading end of the gradation pattern P' around 8400 ms with a trailing end of the gradation pattern P' around 9300 ms, the output wave has a slightly rounder shape at the leading end of the gradation pattern P' around 8400 ms than at the trailing end of the gradation pattern P' around 9300 ms. Looking at the leading end of the gradation pattern P' around 8400 ms carefully, a convergence timing of the sensor output is slightly delayed.

Figure 9:
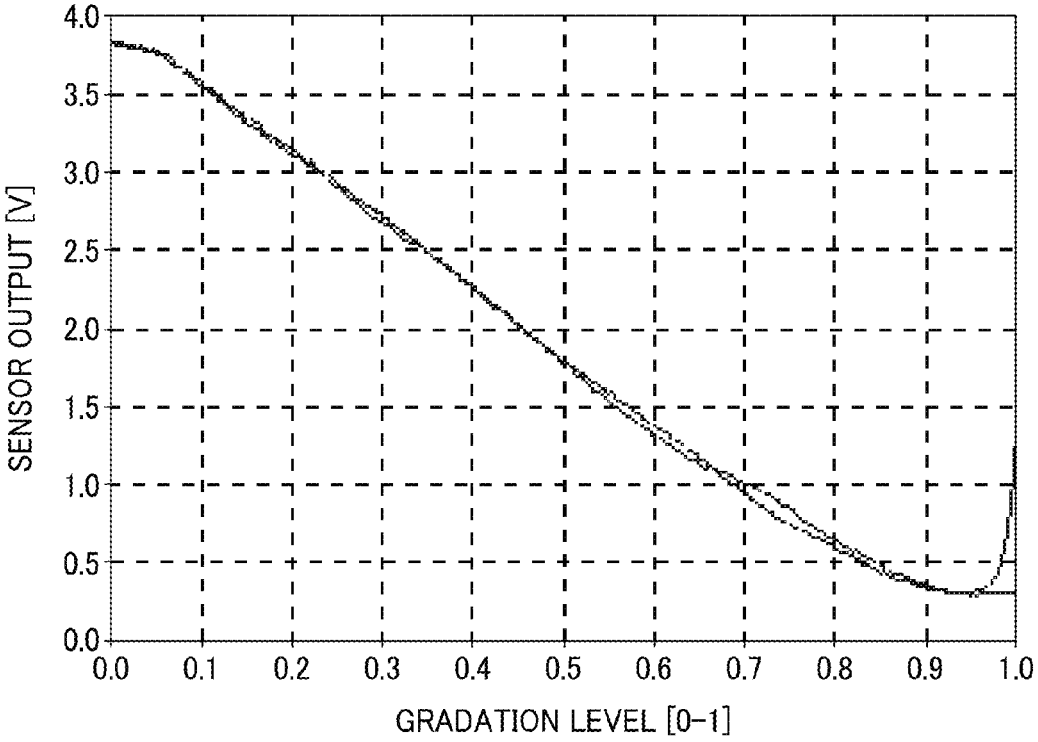
FIG. 9 is a graph of a relation between gradation levels and the detected image density of the gradation pattern of FIG. 7.

FIG. 9 is a graph of a relation between gradation levels (gradation equivalent) and the detected image density of the gradation pattern P'. In other words, FIG. 9 illustrates a detection result of the gradation pattern P' obtained by allocating the gradation levels to the detected image density illustrated in FIG. 8.

It is to be noted that, in FIG. 9, the horizontal axis indicates gradation equivalent standardizing the maximum gradation level 255 to 1, to prevent numerical conditions from being worsened by an enormous value such as 255 to the sixth power when approximation is performed in an n-degree polynomial. The gradation levels are scaled to be in a range of gradation equivalent 0 to 1.0.

FIG. 9 illustrates two lines of detected image density data. One indicates detected image density data in the first pattern P1' of the gradation pattern P'. The other one indicates detected image density data in the second pattern P2' of the gradation pattern P'. Because of the above-described reason, a leading end of the first pattern P1' corresponding to gradation equivalent 0.95 to 1 is not correctly replaced. In other words, in an area of gradation equivalent >0.95, the first pattern P1' is affected by response delay, and therefore is not replaced with a correct gradation equivalent.

Figure 10:
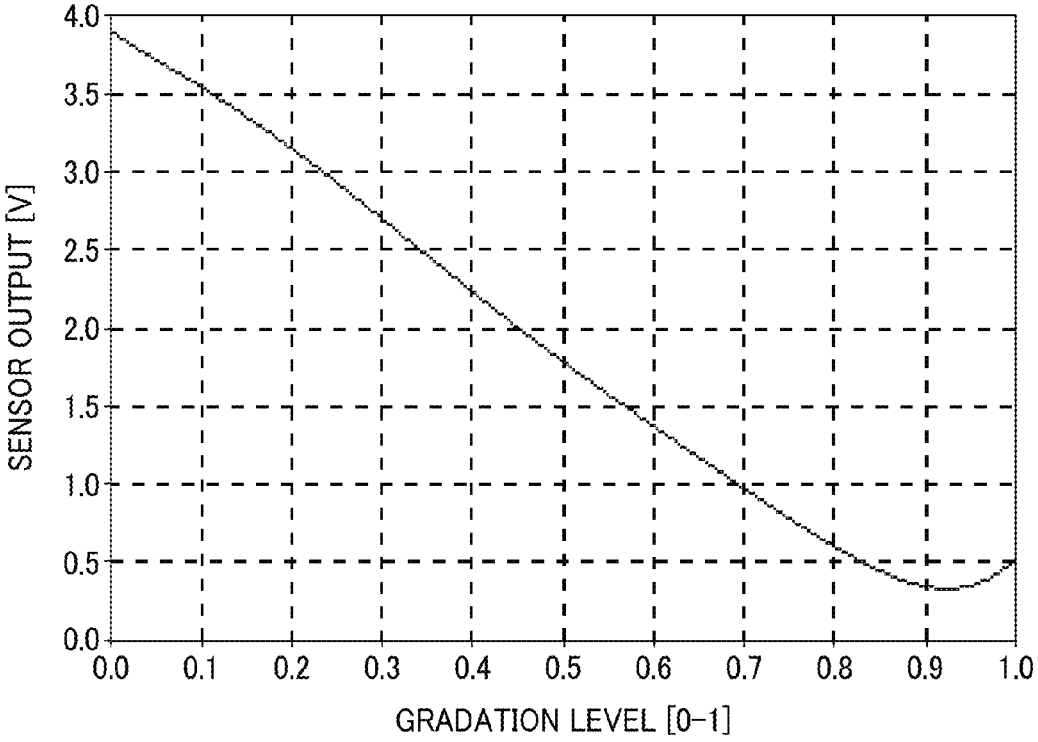
FIG. 10 is a graph of a non-linear function as an approximate function of gradation characteristics determined by using the detected image density of the gradation pattern of FIG. 7.

FIG. 10 is a graph of a non-linear function as an approximate function of gradation characteristics determined by using the detected image density of the gradation pattern P'.

FIG. 10 illustrates the non-linear function as an approximate function achieved by applying quintic approximation to the detected image density data of FIG. 9. According to the non-linear function as an approximate function, the gradation characteristic data can be obtained that shows the relation between image density levels and entire gradation levels (0 to 255) in the gradation range used for correcting the gradation upon multi-gradation image formation. The gradation characteristic data may be referred to as a gradation correction table or gradation conversion table.

In FIG. 10, a correct approximation result is not obtained because of the part of 0.95 to 1 described above. In other words, the approximation result is affected by the response delay.

As is clear from the above description of the comparative example, if a low-pass filter is mounted on a density sensor to prevent noise and to smooth sensor outputs, sensor outputs cannot respond to drastic density changes. As a result, it takes time for the density sensor to accurately output its readings. If it takes time for the density sensor to accurately output its readings, the density sensor may not accurately detect image density of a maximum gradation level part of the first pattern where the image density drastically changes from the image density of a background area of an intermediate transfer belt adjacent to the maximum gradation level part of the first pattern. In short, appropriate gradation correction may not be performed.

According to the present embodiment, the image forming apparatus 600 accurately detects image density of a continuous gradation pattern even with a density sensor having a low-pass filter.

Figure 11:
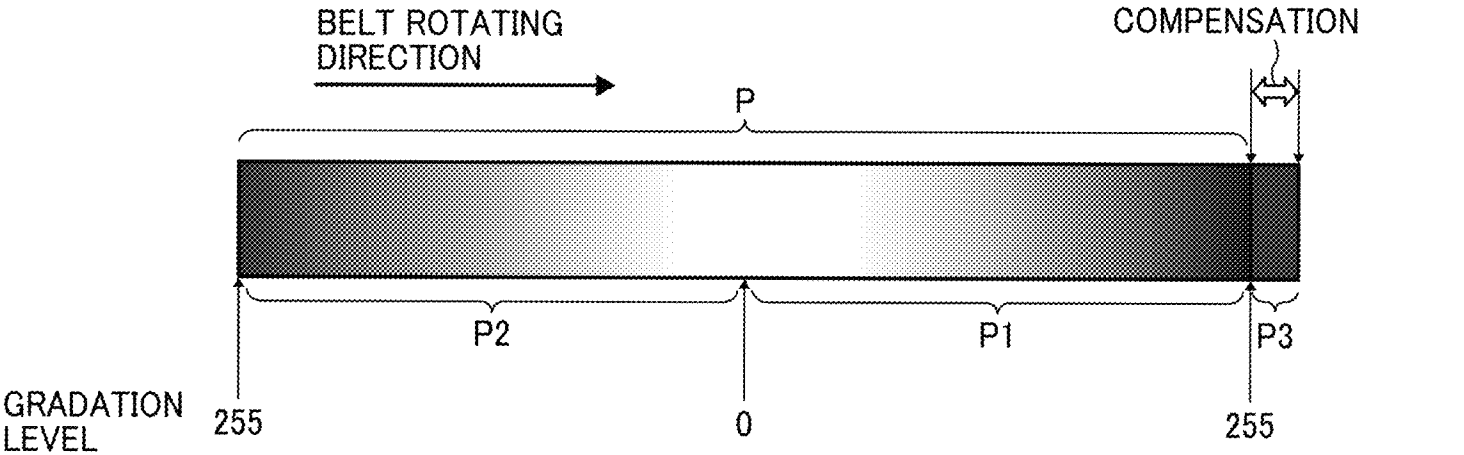
FIG. 11 is a plan view of a gradation pattern according to an embodiment of the present invention.

FIG. 11 is a plan view of a gradation pattern P according to the present embodiment.

In the present embodiment, as illustrated in FIG. 11, a third pattern P3 is formed at a leading end of the gradation pattern P in the belt rotating direction to compensate for delay in sensor characteristics at gradation level 255. The gradation pattern P includes two gradation groups each having 256 gradation levels, namely, a first pattern P1 (first half) of gradation levels 255 to 0 and a second pattern P2 (second half) of gradation levels 0 to 255, continuously disposed in the belt rotating direction. Specifically, the first pattern P1 includes gradations levels changing continuously from a maximum gradation level 255 to a minimum gradation level 0. The second pattern P2 includes gradation levels changing continuously from the minimum gradation level 0 to the maximum gradation level 255. The first pattern P1 and the second pattern P2 of the gradation pattern P are identical in length in the belt rotating direction. Alternatively, the first pattern P1 and the second pattern P2 of the gradation pattern P' may be different in length in the belt rotating direction.

The gradation pattern P is composed of a plurality of adjacent patch patterns having the same width (hereinafter referred to as monospaced patch patterns) disposed without a space between adjacent monospaced patch patterns in the belt rotating direction. Gradation levels of the plurality of adjacent monospaced patch patterns of the gradation pattern P continuously increase or decrease in the belt rotating direction by a constant amount of, e.g., one gradation level or two gradation levels.

If L represents a length of the gradation pattern P, S represents a speed at which the intermediate transfer belt 31 rotates (hereinafter referred to as belt rotating speed), and T represents a sampling period of density detection, then the gradation level per sampling period can be obtained by $(256/L)/(S \times T)$, where, in the present embodiment, L=200 mm, S=440 mm/s, and T=1 ms, for example.

It is to be noted that, in the present embodiment, the maximum gradation level is 255. However, the maximum gradation level can be any level depending on the situation. Preferably, the width of one gradation level of the gradation pattern P is determined so that the output of the density sensor array 37 does not include a flat portion, in other words, the output of the density sensor array 37 constantly has the same rate of gradation increase. The same rate of gradation increase can be achieved when the width of monospaced patch pattern per gradation level is shorter than a detection spot diameter of the density sensor array 37 of, e.g., about 1 mm.

As is described later, because the detected image density data is approximated in a non-linear function using the least-squares approach, the number of pieces of the image density data is at least a number "n" of unknown parameters of the non-linear function. If this condition is not satisfied, an infinite number of non-linear functions that pass a data point exist. Therefore, the solution cannot be specified only by the least-squares approach, and approximation results cannot be trusted.

Thus, the detection spot diameter of the density sensor array 37 satisfies a relation of $Lg \leq D < (Lg \times N1)/(S \times N2)$, where Lg represents the width per gradation level (i.e., the length of the continuous gradation pattern per gradation level in the direction in which the image carrier rotates), D represents the detection spot diameter of the density sensor array 37, N1 represents the number of gradation levels, S represents the linear velocity (i.e., the speed at which the image carrier rotates), and N2 represents the number of unknown parameters of the non-linear function used for approximation (i.e., the approximation function).

Preferably, the number of pieces of the detected image density data is about twice the number "n" of unknown parameters of the non-linear function.

It is to be noted that the only constraint to a lower limit of the detection spot diameter may be an error that may be caused when converting distance into gradation levels because the above-described rate of gradation increase is not perfectly constant. However, the error is at most an increased gradation level from one monospaced patch pattern to the adjacent monospaced patch pattern included in the gradation pattern P.

The third pattern P3 is used to compensate for a response delay for a certain period of time due to low-pass characteristics of the density sensor array 37, because of which the density sensor array 37 cannot respond to sudden changes.

The length of the third pattern P3 in the belt rotating direction is obtained by multiplying a settling time by the belt rotating speed. The settling time is calculated based on a transfer function and a circuit constant of the density sensor array 37, or a response of the density sensor array 37 to a solid pattern having a sufficient length in the belt rotating direction and formed under the density sensor array 37. On the other hand, the length of the third pattern P3 in a belt width direction perpendicular to the belt rotating direction (i.e., the width of the third pattern P3) is the same as the length of the gradation pattern P in the belt width direction (i.e., the width of the gradation pattern P).

It is to be noted that the settling time is generally defined as a time taken for a step response to reach an allowable range of a steady-state value, which is usually about ±2% or about ±5%. In the present embodiment, the settling time is defined as a time taken for a response to a solid belt pattern having a length in the belt rotating direction sufficient to reach a range of about ±2% of a steady-state value. Since a low-pass filter is a linear time-invariant system, the settling time can be specified as a time with respect to an input of a certain value regardless of a solid density level.

Settling time measured under the above-described definition was 20 ms. Accordingly, the third gradation pattern P3 having a length of at least 20 ms×440 mm/s=8.8 mm in the belt rotating direction may be added to the gradation pattern P for delay compensation. In the present embodiment, the length of the third pattern P3 in the belt rotating direction is 10 mm, including a small margin beyond the minimum length thus calculated.

It is to be noted that the step response is an output response when a step input, that is, an input indicating 0 at a time $t<0$, or 1 at a time $t \geq 0$ is applied to a system. The settling time is a time for convergence of the step response. If the system is a linear time-invariant system and has bounded-input bounded-output (BIBO) stability, a response after infinite time elapses has a frequency of zero according to the principle of frequency response. In short, the response after infinite time elapses is a response to a direct current. However, if modes other than the direct current converge within an allowable range, the balance can be regarded as a response to the direct current approximately. In other words, a response after the settling time elapses can be regarded as a direct current component.

A description is now given of a reason for providing the third pattern P3 only on the leading end of the gradation pattern P in the belt rotating direction.

When a detection area (i.e., detection target) of the density sensor array 37 changes from a background area of the intermediate transfer belt 31 to a portion at gradation level 255 of the gradation pattern P adjacent to the background area of the intermediate transfer belt 31, there is a delay for a period of settling time before the density sensor array 37 starts to correctly detect the monospaced patch patterns of the gradation pattern P.

On the other hand, when the detection area of the density sensor array 37 changes from the portion at gradation level 255 of the gradation pattern P at a trailing end thereof in the belt rotating direction to a background area of the intermediate transfer belt 31 adjacent to the portion at gradation level 255 of the gradation pattern P, there is a delay for a period of settling time before the density sensor array 37 starts to correctly detect the background area, which does not affect detection of the monospaced patch patterns of the gradation pattern P by the density sensor array 37.

Figure 12:
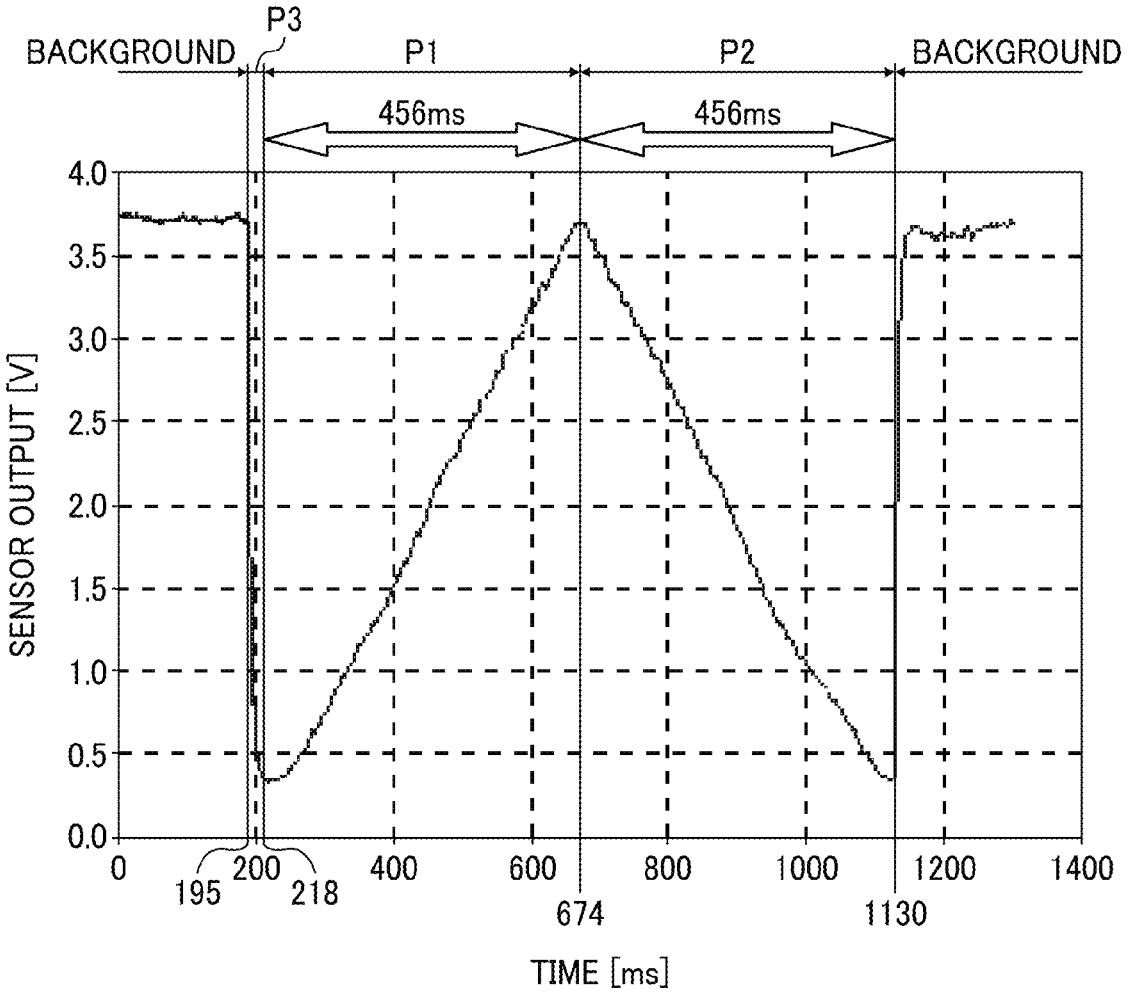
FIG. 12 is a graph of detected image density of the gradation pattern of FIG. 11, illustrating transition of the detected image density over time.

FIG. 12 is a graph of image density of the gradation pattern P detected by the density sensor array 37, illustrating transition of the detected image density over time. In FIG. 12, the vertical axis indicates outputs (V) of the density sensor array 37 that detects the image density of the gradation pattern P. The horizontal axis indicates an elapse of time after the density sensor array 37 starts to detect the image density.

FIG. 12 illustrates detected image density data of background areas of the intermediate transfer belt 31 in a time section from about 0 ms to about 195 ms and a time section starting from about 1130 ms.

FIG. 12 also illustrates detected image density data of the third pattern P3 in a time section from about 195 ms to about 218 ms, and detected image density data of the gradation pattern P (first and second patterns P1 and P2) in a time section from about 218 ms to about 1130 ms.

Since image area ratio changes monotonously in the first and second patterns P1 and P2, the distance can be replaced with the image area ratio.

There is a relatively large difference between a sensor output at the trailing end of the gradation pattern P at about 1130 ms and a sensor output at the background area of the intermediate transfer belt 31 adjacent to the trailing end of the gradation pattern P. Hence, in the present embodiment, taking into account the relatively large difference between the sensor output at the trailing end of the gradation pattern P and the sensor output at the background area of the intermediate transfer belt 31 adjacent to the trailing end of the gradation pattern P, gradation level 255 corresponds to a minimum output detected after the sensor output gets lower than 0.5 V around the trailing end of the gradation pattern P. Pattern data is specified from the detection time.

The second pattern P2 can be identified in a time section of about 456 ms before the time when the minimum output is detected. The first pattern P1 can be identified in a time section of about 456 ms before a leading end of the second pattern P2 in the belt rotating direction.

It is to be noted that the time (T3) when the density sensor array 37 detects the leading end of the gradation pattern P may be calculated in, e.g., $$T3_A = T1 + (T2 - T1) \times L3/(L + L3) \text{ or}$$

$$T3_B = T2 - p \times 2$$

where: L3 represents a length (mm) of the third pattern P3 in the belt rotating direction; L represents a length (mm) of the gradation pattern P in the belt rotating direction (accordingly, a length (mm) of the first pattern P1 in the belt rotating direction is L/2 and a length (mm) of the second pattern P2 in the belt rotating direction is L/2); T1 represents a detection time (s) at a leading end of the third pattern P3 in the belt rotating direction, measured in the image forming apparatus 600; T2 represents a detection time (s) at the trailing end of the gradation pattern P, measured in the image forming apparatus 600; "p" represents a time (s) for the patterns P1 to P3 pass the density sensor array 37, calculated based on the length of the patterns P1 to P3 and the linear velocity of the intermediate transfer belt 31; and T3 represents a detection time (s) at the leading end of the gradation pattern P, more specifically, each of T3_A and T3_B represents a detection time (s) at the leading end of the gradation pattern P.

The detection time at the leading end of the gradation pattern P can be accurately obtained with an average of T3_A and T3_B, more than that obtained by simply performing an inverse operation from the detection time at the trailing end of the gradation pattern P.

Figure 13:
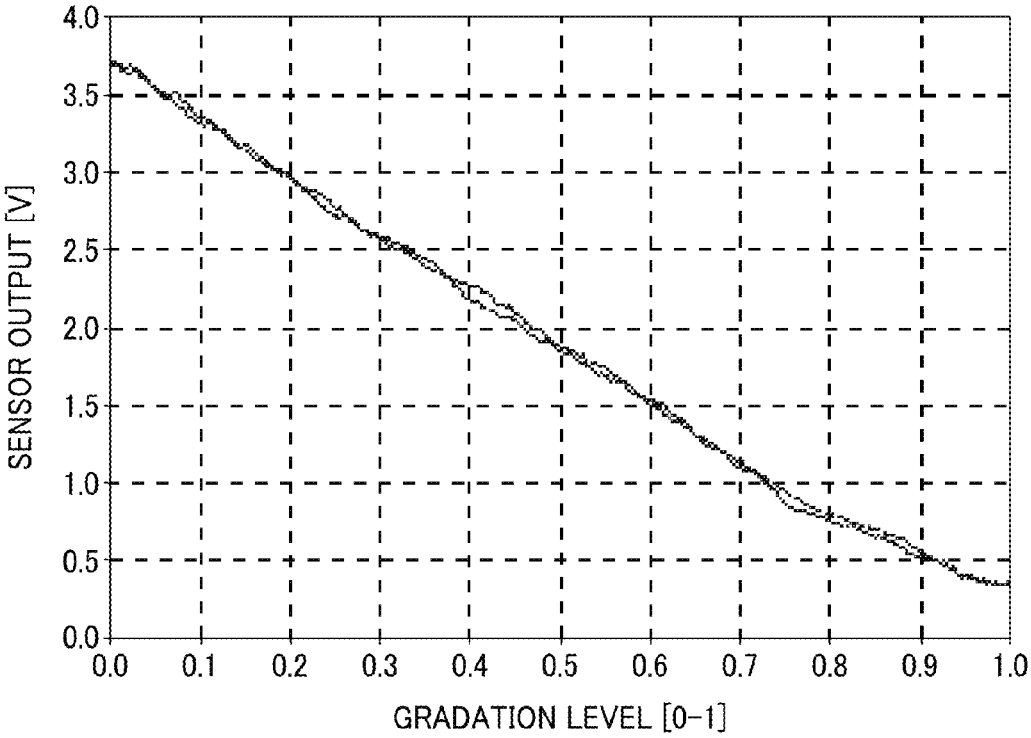
FIG. 13 is a graph of a relation between gradation levels and the detected image density of the gradation pattern of FIG. 11.

FIG. 13 is a graph of a relation between gradation levels (gradation equivalent) and the detected image density of the gradation pattern P. In other words, FIG. 13 illustrates a detection data of the gradation pattern P obtained by allocating the gradation levels to the detected image density illustrated in FIG. 12.

It is to be noted that, in FIG. 13, a horizontal axis indicates gradation equivalent standardizing the maximum gradation level 255 to 1, to prevent numerical conditions from being worsened by an enormous value such as 255 to the sixth power when approximation is performed in the n-degree polynomial. The gradation levels are scaled to be in a range of gradation equivalent 0 to 1.0.

FIG. 13 illustrates two lines of detected image density data. One indicates detected image density data in the first pattern P1 of the gradation pattern P. The other indicates detected image density data in the second pattern P2 of the gradation pattern P.

As illustrated in FIG. 13, sensor outputs of the first and second patterns P1 and P2 are correctly obtained around gradation equivalent of 1.0 (corresponding to gradation level 255).

Approximation of all the detected pieces of image density data in the first pattern P1 and the second pattern P2 is executed by applying the least-squares approach. Accordingly, a non-linear function is determined as an approximate function that approximates the relation between image density and the plurality of gradation levels in the gradation range used for forming the multi-gradation image.

Figure 14:
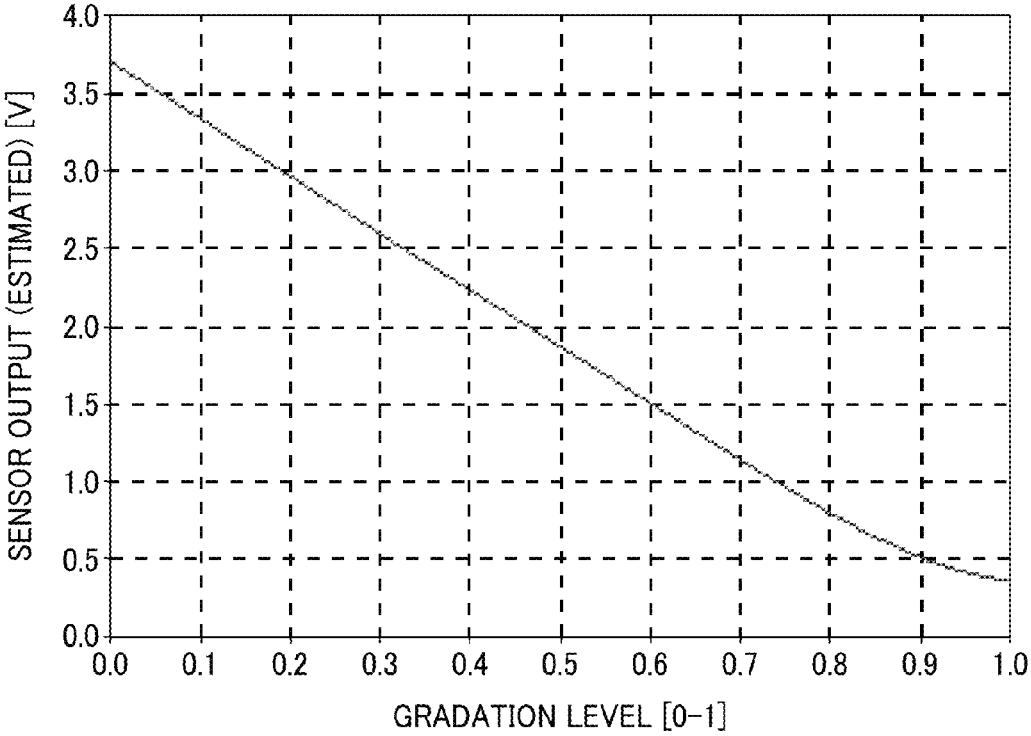
FIG. 14 is a graph of a non-linear function as an approximate function of gradation characteristics determined by using the detected image density of the gradation pattern of FIG. 11.

FIG. 14 is a graph of a non-linear function as an approximate function of gradation characteristics determined by using the detected image density of the gradation pattern P.

FIG. 14 illustrates the non-linear function as an approximate function achieved by applying quintic approximation to the detected image density data of FIG. 13. According to the non-linear function as an approximate function, the gradation characteristic data can be obtained that shows the relation between image density levels and entire gradation levels (0 to 255) in the gradation range used for correcting the gradation upon multi-gradation image formation. The gradation characteristic data may be referred to as a gradation correction table or gradation conversion table.

The gradation correction after obtaining the gradation characteristic data can be performed in a typical manner. For example, upon multi-gradation image formation, gradation correction (γ conversion) is performed on the image data of the image to be outputted by using the gradation characteristic data to obtain a target image density, that is, target gradation characteristics, for each gradation level.

The gradation level is zero at the intercept between the horizontal axis and vertical axis when applying quintic approximation to the detected image density data of FIG. 13, which is a gradation level of a background area without toner attached thereto. An accurate output of the density sensor array 37 relative to the background area can be obtained by detecting an area without toner. Specifically, the exposed surface of the intermediate transfer belt 31 is detected by the density sensor array 37 in advance. By fixing the detected value to the interception and applying the least-squares approach, approximation can be executed with higher accuracy. Accordingly, an accurate approximate function (non-linear function) can be achieved.

In some cases, because of software or hardware defects, a part of the gradation pattern P may not be formed on the intermediate transfer belt 31.

In the present embodiment, a predetermined number of data pieces are sampled from the trailing end of the gradation pattern P to the leading end of the third pattern P3. Accordingly, an error correction process can be performed because it can be determined that the third pattern P3 is not correctly formed when a point reached from the trailing end of the gradation pattern P by the number of data pieces sampled does not satisfy a threshold condition of the trailing end of the gradation pattern P.

Figure 15:
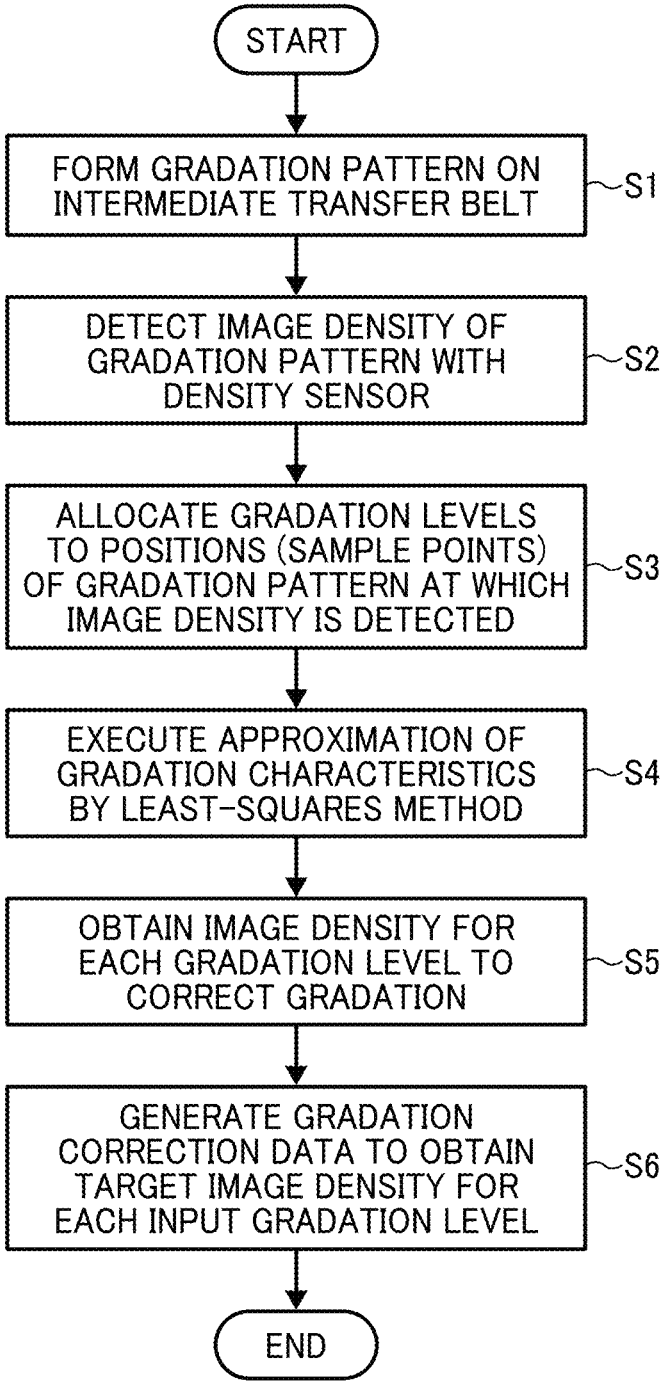
FIG. 15 is a flowchart of a process of generating gradation characteristic data in the image forming apparatus of FIG. 1.

FIG. 15 is a flowchart of a process of generating gradation characteristic data in the image forming apparatus 600.

In FIG. 15, firstly, the gradation pattern P is formed on the intermediate transfer belt 31 (S1). Then, the density sensor array 37 detects the image density of the gradation pattern P formed on the intermediate transfer belt 31 (S2).

Then, using a constant rate of change in gradation with respect to time, the gradation levels are allocated to individual positions (sample points) of the gradation pattern P at which image density is detected (S3).

Then, approximation of the gradation characteristics is executed by the non-linear function, using the least-squares approach, with the gradation levels as input and the output level of the density sensor array 37 as output (S4).

Then, the image density for each of the gradation levels 0 to 255 is obtained to correct gradation, by inputting each of the gradation levels 0 to 255 to the non-linear function (approximation formula) (S5).

Then, the gradation correction data (gradation correction table or gradation conversion table) is generated to obtain a target image density, that is, target gradation characteristics, for each gradation level inputted (S6). The gradation is corrected using the gradation characteristic data thus generated.

According to the above-described embodiment, the gradation pattern P is used as a gradation correction pattern. The gradation pattern is composed of a plurality of monospaced patch patterns disposed without a space between adjacent monospaced patch patterns in the belt rotating direction. Gradation levels evenly increase or decrease in the belt rotating direction from one monospaced patch pattern to an adjacent monospaced patch pattern.

For example, the gradation level of one monospaced patch pattern increases or decreases to the gradation level of the adjacent monospaced patch pattern by one gradation level. Alternatively, the gradation level of one monospaced patch pattern increases or decreases to the gradation level of the adjacent monospaced patch pattern by two gradation levels.

The gradation pattern composed of the plurality of monospaced patch patterns disposed at equal intervals is formed on the intermediate transfer belt 31 that rotates at a predetermined speed. The image density of the gradation pattern P is detected on the intermediate transfer belt 31. Accordingly, the image density is detected at each position for each gradation level.

For example, if gradation levels 0 to 100 are allocated to the gradation pattern P having a length of, e.g., 10 mm, the gradation level increases by 10 gradation levels per 1 mm of the gradation pattern P.

The image density of the gradation pattern P is sampled and detected at predetermined time intervals. Accordingly, adjacent sampling positions at which image density is detected exist at predetermined intervals.

For example, if gradation levels 0 to 100 are allocated to the gradation pattern P having a length of, e.g., 10 mm and 1000 samples are taken from the gradation pattern P, the gradation level increases by 0.1 gradation level per sample.

It is to be noted that "variation" as a noise component existing in the detected image density data of the gradation pattern may be caused by a combination of factors, such as noise of the density sensor array 37, deformation of the intermediate transfer belt 31, and uneven density within the gradation pattern P.

Therefore, the "variation" as a noise component existing in the detected image density data of the gradation pattern can be regarded as Gaussian white noise. Accordingly, by executing approximation of a large amount of pieces of detected image density data including the "variation" by a non-linear function (e.g., n-degree polynomial), smooth and accurate fitting can be achieved to generate accurate gradation correction data.

Instead of a typical way of accurately detecting density for a gradation level, rough image density is detected for a plurality of gradation levels according to the above-described embodiment. With the detection data, the density for all the gradation levels used for forming the multi-gradation image can be accurately corrected.

Although specific embodiments are described, the configuration of the image forming apparatus according to this patent specification is not limited to those specifically described herein. Several aspects of the image forming apparatus are exemplified as follows.

According to a first aspect, there is provided an image forming apparatus (e.g., image forming apparatus 600), which includes an image carrier (e.g., intermediate transfer belt 31), an image forming unit (e.g., image forming unit 100), a density sensor (e.g., density sensor array 37), a gradation characteristic data generator (e.g., controller 611), and a gradation corrector (e.g., color/gradation correction unit 604). The image carrier is rotatable at a predetermined speed to carry an image on a surface thereof. The image forming unit forms a multi-gradation image on the image carrier. The density sensor detects density of the multi-gradation image formed on the image carrier. The density sensor includes a low-pass filter to remove a high-frequency component of an output of the image density sensor. The gradation characteristic data generator forms a gradation correction pattern (e.g., gradation pattern P) on the image carrier with the image forming unit and detects image density of the gradation correction pattern using the density sensor to generate gradation characteristic data that shows a relation between the image density and a plurality of gradation levels in a gradation range used for forming the multi-gradation image according to a detected image density of the gradation correction pattern. The gradation corrector corrects image data of the multi-gradation image to be outputted, according to the gradation characteristic data. The gradation correction pattern is a continuous gradation pattern including a first pattern (e.g., first pattern P1) and a second pattern (e.g., second pattern P2). In the first pattern, gradation levels change continuously from a maximum gradation level (e.g., gradation level 255) to a minimum gradation level (e.g., gradation level 0) in the gradation range. In the second pattern, gradation levels change continuously from the minimum gradation level to the maximum gradation level in the gradation range. The second pattern is continuous with the first pattern in a direction in which the image carrier rotates. The gradation characteristic data generator continuously detects, with the density sensor, image density of the continuous gradation pattern formed on the image carrier and image density of background areas adjacent to a leading end and a trailing end of the continuous gradation pattern, respectively, in the direction in which the image carrier rotates, in a predetermined sampling period, to generate the gradation characteristic data according to detected image density of the continuous gradation pattern and image density of the background areas. The gradation characteristic data generator forms a compensation pattern (e.g., third pattern P3) on the surface of the image carrier in front of the first pattern in the direction in which the image carrier rotates. The compensation pattern is continuous with the first pattern, and has a length in the direction in which the image carrier rotates sufficient to compensate for a response delay of the output of the density sensor due to the low-pass filter.

In the first aspect, by forming the compensation pattern in front of and continuous with the first pattern, the density sensor continuously detect image density of the compensation pattern and image density of a maximum gradation level part of the first pattern, in which the image density of the compensation pattern and the image density of the maximum gradation level part of the first pattern are the same. In other words, there is no drastic density change between the compensation pattern and the maximum gradation level part of the first pattern. Accordingly, the response delay of the output of the density sensor using the low-pass filter can be prevented. Even if a drastic density change is caused between the background area of the image carrier and the compensation pattern, the density sensor detects the image density of the maximum gradation level part of the first pattern in a state in which the density sensor can provide an accurate output. Accordingly, the density sensor including the low-pass filter can accurately detect the image density of the maximum gradation level part, and therefore, the density sensor can accurately detect the image density of the continuous gradation pattern to correct the gradation as appropriate.

According to a second aspect, the gradation characteristic data generator obtains a time, according to detection data provided by the density sensor, when a detection target is changed from the trailing end of the continuous gradation pattern to the background area of the image carrier adjacent to the trailing end of the continuous pattern, and calculates a gradation level based on the time, the predetermined sampling period, a length of the continuous gradation pattern per gradation level in the direction in which the image carrier rotates, and a speed at which the image carrier rotates. Accordingly, as in the embodiment described above, the gradation levels at the respective positions of the continuous gradation pattern at which image density is detected can be accurately calculated even if the speed at which the image carrier rotates varies and/or the length of the continuous gradation pattern varies.

According to a third aspect, the gradation characteristic data generator determines an approximation function that approximates the relation between the image density and the plurality of gradation levels in the gradation range according to detection data of the continuous gradation pattern, and generates the gradation characteristic data using the approximation function. Accordingly, as in the embodiment described above, the gradation characteristic data can be accurately generated that shows the relation between the image density and the gradation levels without increasing the number of positions of the continuous gradation pattern at which the image density is detected.

According to a fourth aspect, detected image density of the background areas of the image carrier is used as the image density when the gradation level used for determining the approximation function is zero. Accordingly, as in the embodiment described above, more accurate approximation can be performed than a typical approximation.

According to a fifth aspect, the length of the continuous gradation pattern per gradation level in the direction in which the image carrier rotates and a detection spot diameter of the density sensor satisfies a relation of $Lg \leq D < (Lg \times N1)/(S \times N2)$, where Lg represents the length of the continuous gradation pattern per gradation level in the direction in which the image carrier rotates, D represents the detection spot diameter of the density sensor, N1 represents number of gradation levels, S represents the speed at which the image carrier rotates, and N2 represents number of unknown parameters of the approximation function.

Accordingly, as in the embodiment described above, more accurate approximation can be performed than a typical approximation.

According to a sixth aspect, the gradation characteristic data generator obtains a time, according to detection data provided by the density sensor, when the detection target is changed from a background area of the image carrier to the leading end of the continuous gradation pattern, and determines whether a pattern is extracted or not based on existence of the pattern at the time. Accordingly, as in the embodiment described above, an error correction process can be performed when the pattern is not correctly extracted.

According to a seventh aspect, the first pattern of the continuous gradation pattern and the second pattern of the continuous gradation pattern are identical in length in the direction in which the image carrier rotates. Accordingly, as in the embodiment described above, image density at a gradation level in the first pattern of the continuous gradation pattern can be detected concurrently with image density at the same gradation level in the second pattern of the continuous gradation pattern. This ensures reduction of the influence of variations in image density detected at the respective positions of the continuous gradation pattern caused by e.g., noise.

According to an eighth, the first pattern of the continuous gradation pattern and the second pattern of the continuous gradation pattern are different in length in the direction in which the image carrier rotates. Accordingly, as in the embodiment described above, image density can be detected for different gradation levels in the first pattern and the second pattern of the continuous gradation pattern. The number of the gradation levels at the respective positions of the continuous gradation pattern at which image density is detected increases, and sufficient image density data for the gradation levels can be obtained. Accordingly, the gradation characteristic data can be accurately generated. The approximation function can be accurately determined.

The present invention has been described above with reference to specific exemplary embodiments. It is to be noted that the present invention is not limited to the details of the embodiments described above, but various modifications and enhancements are possible without departing from the scope of the invention. It is therefore to be understood that the present invention may be practiced otherwise than as specifically described herein. For example, elements and/or features of different illustrative exemplary embodiments may be combined with each other and/or substituted for each other within the scope of this invention. The number of constituent elements and their locations, shapes, and so forth are not limited to any of the structure for performing the methodology illustrated in the drawings.

What is claimed is:

1. An image forming apparatus comprising:

an image carrier rotatable at a predetermined speed, to carry an image on a surface thereof;

an image forming unit to form a multi-gradation image on the image carrier;

a density sensor to detect density of the multi-gradation image formed on the image carrier, comprising a low-pass filter to remove a high-frequency component of an output of the density sensor;

a gradation characteristic data generator to form a gradation correction pattern on the image carrier with the image forming unit, to detect image density of the gradation correction pattern using the density sensor, and to generate gradation characteristic data that shows a relation between the image density and a plurality of gradation levels in a gradation range used for forming the multi-gradation image according to a detected image density of the gradation correction pattern; and a gradation corrector to correct image data of the multi-gradation image to be outputted according to the gradation characteristic data, the gradation correction pattern being a continuous gradation pattern including:

a first pattern having gradation levels changing continuously from a maximum gradation level to a minimum gradation level in the gradation range; and a second pattern continuous with the first pattern in a direction in which the image carrier rotates, and having gradation levels changing continuously from the minimum gradation level to the maximum gradation level in the gradation range, the gradation characteristic data generator continuously detecting, with the density sensor, image density of the continuous gradation pattern formed on the image carrier and image density of background areas adjacent to a leading end and a trailing end of the continuous gradation pattern, respectively, in the direction in which the image carrier rotates, in a predetermined sampling period, to generate the gradation characteristic data according to detected image density of the continuous gradation pattern and image density of the background areas, the gradation characteristic data generator forming a compensation pattern on the surface of the image carrier next to a leading end of the first pattern in the direction in which the image carrier rotates, the compensation pattern being continuous with the first pattern and having a length in the direction in which the image carrier rotates sufficient to compensate for a response delay of the output of the density sensor due to the low-pass filter.

2. The image forming apparatus according to claim 1, wherein the gradation characteristic data generator obtains a time, according to detection data provided by the density sensor, when a detection target is changed from the trailing end of the continuous gradation pattern to the background area of the image carrier adjacent to the trailing end of the continuous gradation pattern, and calculates a gradation level based on the time, the predetermined sampling period, a length of the continuous gradation pattern per gradation level in the direction in which the image carrier rotates, and a speed at which the image carrier rotates.

3. The image forming apparatus according to claim 1, wherein the gradation characteristic data generator determines an approximation function that approximates the relation between the image density and the plurality of gradation levels in the gradation range according to detection data of the continuous gradation pattern, and generates the gradation characteristic data using the approximation function.

4. The image forming apparatus according to claim 3, wherein detected image density of the background areas of the image carrier is used as the image density when the gradation level used for determining the approximation function is zero.

5. The image forming apparatus according to claim 3, wherein the length of the continuous gradation pattern per gradation level in the direction in which the image carrier rotates and a detection spot diameter of the density sensor satisfies a relation of $Lg \leq D < (Lg \times N1)/(S \times N2)$, where Lg represents the length of the continuous gradation pattern per gradation level in the direction in which the image carrier rotates, D represents the detection spot diameter of the density sensor, N1 represents number of gradation levels, S represents the speed at which the image carrier rotates, and N2 represents number of unknown parameters of the approximation function.

6. The image forming apparatus according to claim 1, wherein the gradation characteristic data generator obtains a time, according to detection data provided by the density sensor, when the detection target is changed from a background area of the image carrier to the leading end of the continuous gradation pattern, and determines whether a pattern is extracted or not based on existence of the pattern at the time.

7. The image forming apparatus according to claim 1, wherein the first pattern of the continuous gradation pattern and the second pattern of the continuous gradation pattern are identical in length in the direction in which the image carrier rotates.

8. The image forming apparatus according to claim 1, wherein the first pattern of the continuous gradation pattern and the second pattern of the continuous gradation pattern are different in length in the direction in which the image carrier rotates.

* * * * *